United States Patent [19]

Koser et al.

[11] Patent Number: 4,585,284

[45] Date of Patent: Apr. 29, 1986

[54] TRANSITION ADAPTER CONNECTOR EMPLOYING A PRINTED CIRCUIT BOARD

[75] Inventors: James R. Koser, Elizabethtown; Ralph A. Papa, Harrisburg, both of Pa.

[73] Assignee: E. I. Du Pont de Nemours and Company, Wilmington, Del.

[21] Appl. No.: 653,381

[22] Filed: Sep. 21, 1984

[51] Int. Cl.[4] ..... H01R 9/09

[52] U.S. Cl. ..... 339/17 C; 339/14 R; 339/91 R

[58] Field of Search ..... 339/17 R, 17 C, 17 D, 339/17 L, 17 LC, 17 LM, 17 M, 17 N, 156 R, 143 R, 14 R, 193 P, 91 R, 206 R, 206 P

[56] References Cited

U.S. PATENT DOCUMENTS

| | | | |
|---|---|---|---|
| 3,551,874 | 12/1970 | Volinskie | 339/17 R |
| 4,012,094 | 3/1977 | VanRenssen | 339/193 P |
| 4,072,402 | 2/1978 | Butler | 339/136 M |
| 4,080,028 | 3/1978 | Gilbert | 339/17 L |
| 4,272,145 | 6/1981 | LaDuke | 339/91 R |
| 4,331,370 | 5/1982 | Andrews et al. | 339/17 M |
| 4,389,021 | 6/1983 | Coldren | 339/126 R |
| 4,433,886 | 2/1984 | Cassarly et al. | 339/14 R |
| 4,440,463 | 3/1984 | Gliha, Jr. et al. | 339/14 R |

FOREIGN PATENT DOCUMENTS

| | | | |
|---|---|---|---|
| WO83/00456 | 10/1983 | PCT Int. 'l Appl. | 339/17 C |

*Primary Examiner*—Neil Abrams

[57] ABSTRACT

The connector assembly contains a circuit board having lead lines on each side connected electrically to through holes with electrical terminals mounted therein at a first end. On each side of the circuit board there is a dielectric housing with channels therethrough mating with a second end of the terminals mounted on the circuit board. The terminals within each housing have different spacings between terminals from the terminals of the other housing.

10 Claims, 9 Drawing Figures

TRANSITION ADAPTER CONNECTOR EMPLOYING A PRINTED CIRCUIT BOARD

BACKGROUND OF THE INVENTION

1. Field of the Invention

This invention relates to an electrical connector for input/output interface between different electrical systems. More specifically, it refers to a transition input-/output adapter connector assembly employing a circuit board to provide interconnection between different electrical systems.

2. Prior Art

U.S. Pat. No. 4,331,370 relates to a system for providing input/output paths to and from a densely crowded multilayer printed circuit board. A pair of cards for connectors with plated through holes and modules formed from insulative material provide input/output signal paths in a printed circuit board. The necessity for both a pair of modules and a pair of cards makes this system too large for present-day miniaturization.

U.S. Pat. No. 4,440,463 describes an electrical connector having a plastic ground insert which is metallized. This type of connector provides a means for electrically grounding electrode portions of at least some of the conected contacts to an outer shell connector. This system cannot be used to provide a transition from one width spacing to a second width spacing, although being of value as a grounding method.

SUMMARY OF THE PRESENT INVENTION

The present invention discloses an assembly for providing an input/output interface with IBM 360 and 370 computers, plug compatible main frame, and related peripheral equipment. In addition, this system provides an interface for today's high speed, high performance cable systems usually terminated to 0.100 inch×0.100 inch center grid spacing female connectors. The invention provides a grid sized transition from 0.125 inch×0.250 inch centers IBM input/output systems to any desired grid size; for instance, the 0.100 inch×0.100 inch standard grid or other standard grids such as used on military-type D-subminiatures. This connector uses fewer cables and connectors than other types of systems having a similar function. It has minimum changes and interruptions in signal paths and it provides the ultimate in flexibility. This connector employs a circuit board with through holes providing the grid system for going from 0.125×0.250 inch centers to the standard grids. This is accomplished by using the paths of the circuit board as the transition mechanism. The number and size of spacing can be varied as desired by the user and adequate grounding systems can be inserted. A typical system employs serpent-type terminals at one side and square pins at the other side going through the circuit board. Serpent terminals are housed in a thermoplastic housing and this housing is clipped to one side of the circuit board by way of the metal housing clip. At the other side of the circuit board, a 2×25 position header is plugged over the pins and a cover is placed around the header to form a compact assembled unit.

DESCRIPTION OF THE PRESENT INVENTION

Figure 1:
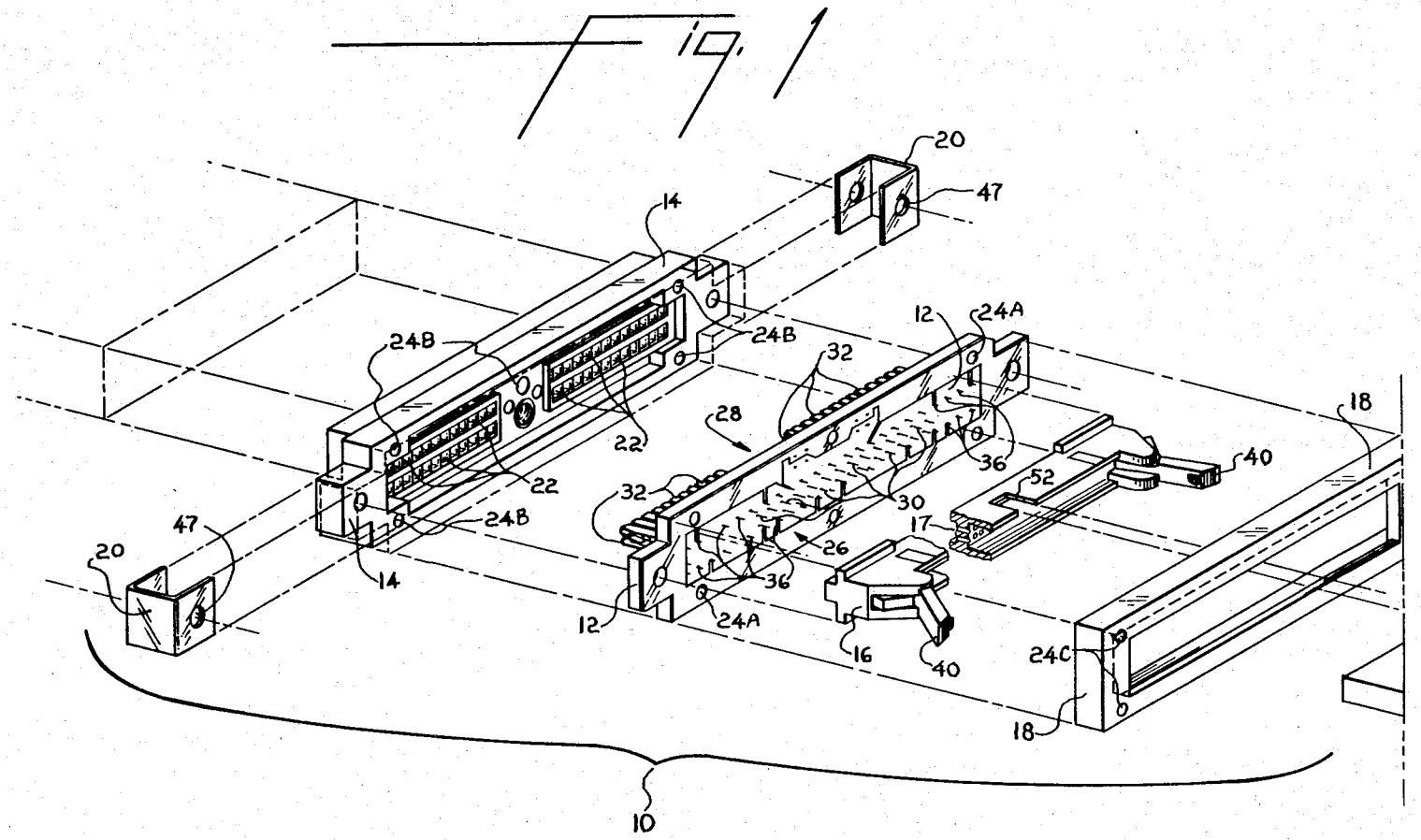
FIG. 1 is an exploded perspective view of the adapter connector providing a transition from 0.125×0.250 inch to 0.100×0.100 inch spacing.

The input/output adapter connector assembly 10 shown in FIG. 1 comprises multiple parts. One part is the circuit board 12 having through holes therein the terminals 30 and 32 mounted in the holes. The terminal may have any type of electrical connection on each side. However, in the view shown in FIG. 1, a square pin 30 is shown on the second side of board 12 and serpent terminals 32 are shown on the first side of board 12. The front end or second side 26 of the circuit board 12 is adapted for mounting to a quick eject header such as 16. The back end or first side 28 of the circuit board 12 is mounted to a dielectric housing 14 having terminal receiving channels 22 sized to accept the serpent terminals 32.

Mounting clip 20 holds the circuit board 12 to the housing 14. The clip 20 also provides electrical grounding from the printed circuit board 12 to the housing 14 and the mounting panel 70.

The quick-eject header 16 has through holes (shown as 17 in the broken away section of header 16 in FIG. 1) through which the pins 30 of the circuit board pass when the header 16 is mated to board 12. A cover 18 encloses the front end 26 of the circuit board 12 and retains the quick-eject header 16 in position after bolts are in place as described below. Latches 40 on the quick-eject header 16 mate with latch notch 44 on the ribbon cable connector 42, having a standard connection (not shown) to cable 46. Female ends of the cable connector 42 mate to the pins 30 of the circuit board 12. The polarizing tab 50 on the ribbon cable connector 42 mates with the polarizing slot 52 in the quick-eject header 16.

A pin 48 through hole 47 can be used to hold the mounting clip 20, the circuit board 12 and housing 14 together. Holes 24B in the housing 14, holes 24A in the board 12 and holes 24C in the cover 18 accept screws or bolts to hold the entire assembly together.

Figure 4:
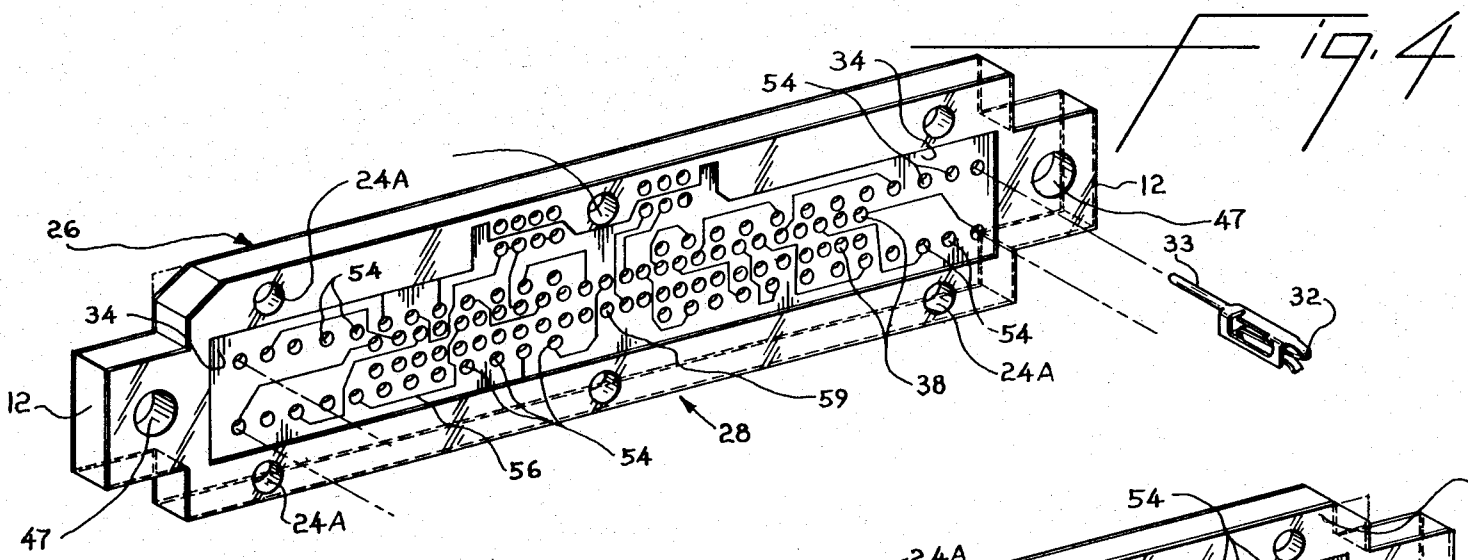
FIG. 4 is an enlarged view of the circuit board first side with the terminal insertion holes ready for acceptance of a serpent terminal.
Figure 5:
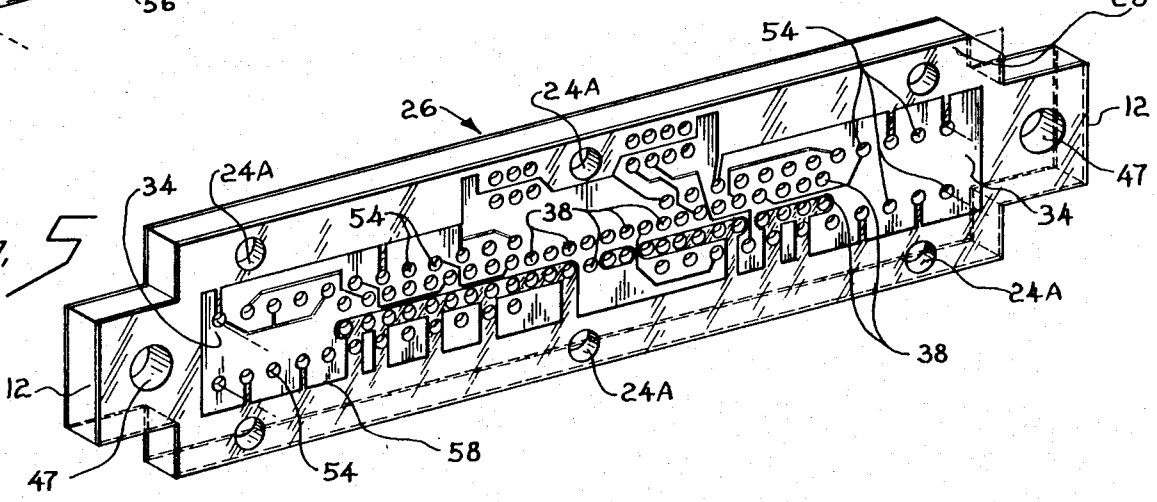
FIG. 5 is an enlarged view of the circuit board with ground lead having a different configuration than shown in FIG. 4.

The circuitry area 34 on the circuit board 12 can vary as shown in FIGs. 4 and 5. Any number of positions can be accommodated. Any number of ground terminations can be provided. Spacings and electrical configurations can be changed. Referring to FIGS. 4 and 5, the first side 28 receives the serpent terminal 32 in holes 54. Holes 38 receive the ends of terminals 30 inserted in from second side 26 and soldered to the circuit board holes by a state of the art vapor phase process. The end 33 of terminal 32, after insertion, is visible on side 26 where it is soldered by the same vapor phase process. Lead line 58 shows a typical ground line and lead line 59 shows a typical signal line in the grid pattern.

Figure 6:
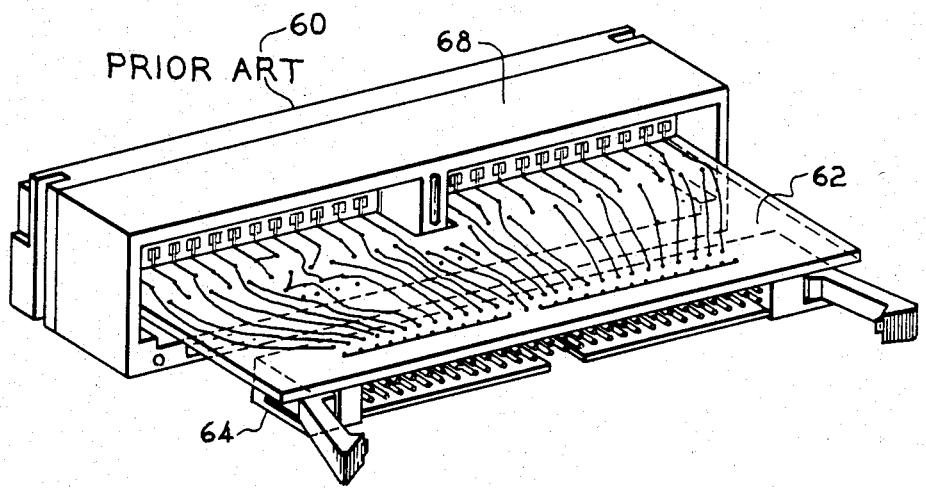
FIG. 6 is a perspective view of the prior art circuit board connector assembly.

The prior art device 60 shown in FIG. 6 is much more complex and larger requiring a circuit board 62 sticking out from the housing 68 and a right-angled header 64 attached to the circuit board.

Figure 2:
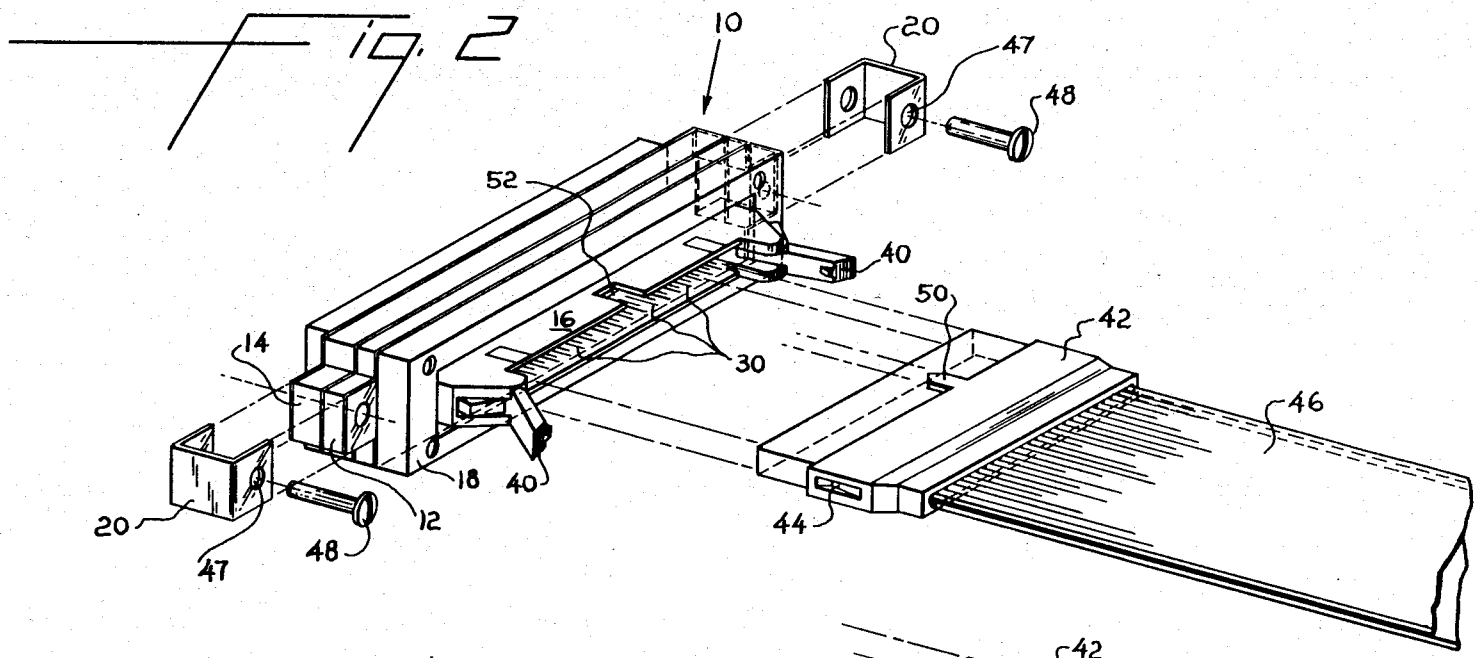
FIG. 2 is a perspective view of a connector assembly and a typical mating ribbon cable connector.
Figure 3:
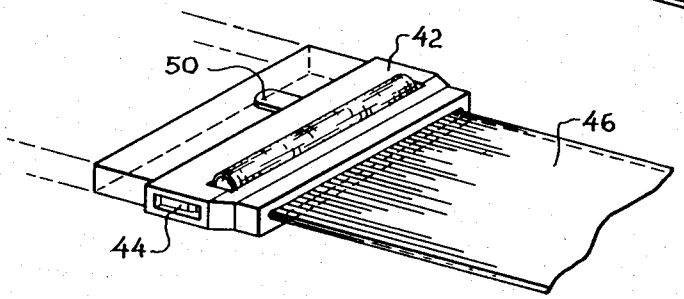
FIG. 3 is a perspective view of the ribbon cable connector which is attached to a transition adapter connector.
Figure 7:
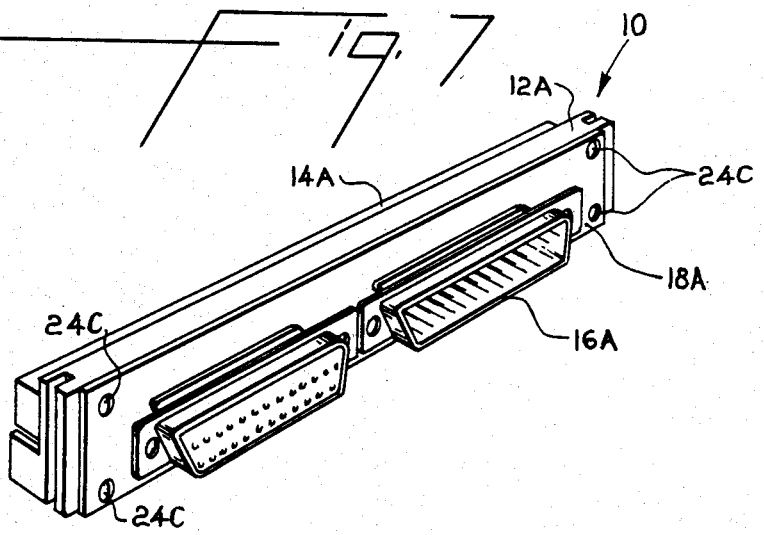
FIG. 7 is a perspective view of the assembled connector with a D-subminiature outer housing.

An alternate housing used for the present invention employs a D-subminiature header 16A in place of the quick eject header 16, as shown in FIG. 7. The cover 18*a*, circuit board 12*a* and housing 14*a* function in the same manner as the corresponding parts shown in FIGS. 1 and 2. This configuration will conform to standard military specifications such as MIL-C-24308.

Figure 8:
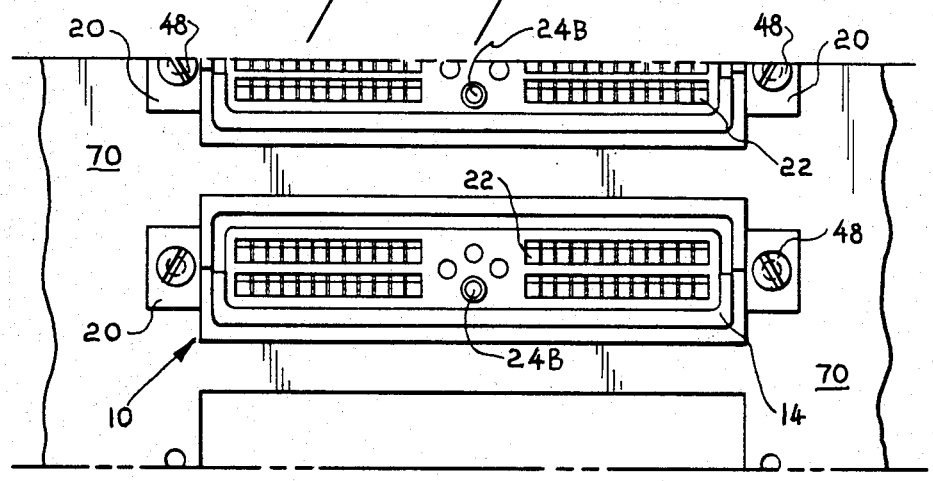
FIG. 8 is an elevation view of the connector mounted on a panel with bolt mounts.
Figure 9:
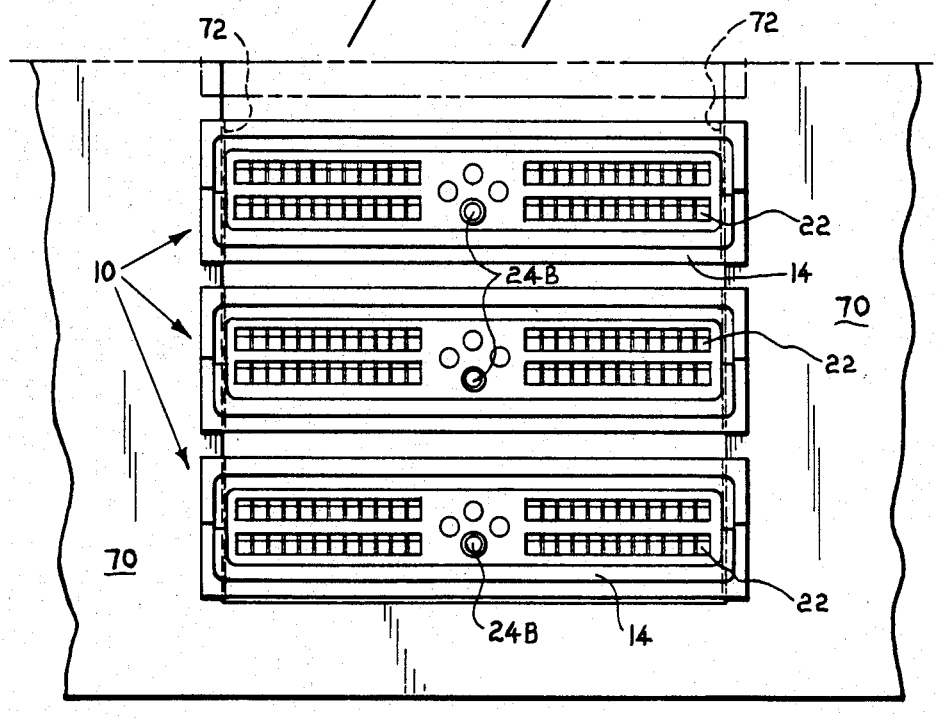
FIG. 9 is an elevation view of the connector mounted on a panel with slide mounts.

FIGS. 8 and 9 show different methods of mounting the assembly 10 to a panel 70 such as found on a computer. In FIG. 8 the assembly 10 is screwed in place through hole 24B and grounded to the panel 70 with clip 20 and bolt 48. The dielectric housing 14 will accept a mating connector's terminal through channel 22. In FIG. 9 the assembly 10 is slid into grooves 72 instead of being bolted to the panel 70. One or more of the terminals 32 (not shown) within channels 22 will act as the ground.

The assembly disclosed herein provides a means for increasing or changing the number of input/output signal paths for any densely packed system and at the same time allows variability from one size spacing to a second size spacing using a minimum of parts in the assembly.

It is understood that the examples of the invention shown herein are preferred embodiments. Changes and modifications can be made without deviating from the basic concept of the invention.

What is claimed is:

1. A transition adapter connector assembly for connecting electrical systems between input/output signal paths comprising:

(a) a circuit board having a first and second side with signal and ground leads on at least one side, in electrical contact with multiple through holes, each through hole having an electrical terminal, with first and second contact ends, mounted therein in electrical contact with the hole at the first contact end, at least some of the terminals projecting the second contact end from the first side of the board and the remainder projecting the second contact end from the second side of the board, (b) a first dielectric housing having multiple terminal receiving channels mating with the second contact end of the terminals on the first side of the circuit board, (c) a second dielectric housing having multiple terminal receiving channels mating with the second contact end of the terminals on the second side of the circuit board, said second dielectric housing having at least one latch member adapted to mate with a notch in a mating ribbon cable connector, and (d) means for holding the assembly together, including a cover enclosing the second dielectric housing having holes which are aligned axially with corresponding axially aligned holes in the circuit board and the first dielectric housing and a fastening means mounted through said holes for securing said housing and board together.

2. A connector assembly according to claim 1 having an electrically conductive clip at an end of the first dielectric housing and circuit board holding the housing and circuit board together and being in electrical contact with the ground leads on the circuit board.

3. A connector assembly according to claim 1 wherein the terminals mounted on the first side of the circuit board are serpents and the terminals mounted on the second side of the circuit board are straight pins.

4. The connector assembly according to claim 1 wherein the assembly is mounted on a computer panel and a ribbon cable connector is mated to the pins on the second side of the circuit board.

5. A connector assembly according to claim 1 mounted by one or more bolts to a panel member.

6. A connector assembly according to claim 1 slide mounted to a panel member.

7. The connector assembly according to claim 3 wherein the assembly is mounted on a computer panel and a ribbon cable connector is mated to the pins on the second side of the circuit board.

8. A transition adapter connector assembly for connecting electrical systems with dissimilar spacings between input/output signal paths comprising:

(a) a circuit board having signal and ground leads on both a first and second side in electrical contact with multiple through holes, a first set of terminals mounted on the first side of the circuit board and a second set of terminals mounted on the second side of the circuit board, each through hole having an electrical terminal from the first or second set mounted therein in electrical contact with the hole, each terminal having a first and second contact end, the first end being inserted into the hole, the spacing between terminals from the first set being different from the spacing between terminals in the second set, (b) a first dielectric housing having multiple terminal receiving channels mating with the second contact end of the terminals on the first side of the circuit board, (c) a second dielectric housing having multiple terminal receiving channels mating with the second multiple end of the terminals on the second side of the circuit board, and (d) means for holding the assembly together, including a cover enclosing the second dielectric housing, said cover, the circuit board and the first dielectric housing, each having at least one hole aligned along the same axis and a fastening means mounted through said axially aligned holes for securing the cover, circuit board and first and second dielectric housing members together.

9. A connector assembly according to claim 8 wherein the second dielectric housing comprises a header with at least one latch member, said latch member adapted to mate with a notch in a mating ribbon cable connector.

10. A connector assembly according to claim 8 wherein the second dielectric housing member is a D-subminiature header.

* * * * *

UNITED STATES PATENT OFFICE

CERTIFICATE OF CORRECTION

PATENT NO. : 4,585,284

DATED : April 29, 1986

INVENTOR(S) : James R. Koser and Ralph A. Papa

It is certified that error appears in the above-identified patent and that said Letters Patent are hereby corrected as shown below:

Claim 8, column 4, line 47, "multiple" should read -- contact --.

Signed and Sealed this

*Twenty-sixth* Day of *August 1986*

[SEAL]

*Attest:*

DONALD J. QUIGG

*Attesting Officer*

*Commissioner of Patents and Trademarks*